US005702257A

United States Patent [19]

Millhimes

[11] Patent Number: 5,702,257

[45] Date of Patent: Dec. 30, 1997

[54] ELECTRICAL CONNECTOR AND TERMINAL THEREFOR

[75] Inventor: Wayne Leroy Millhimes, Hershey, Pa.

[73] Assignee: The Whitaker Corporation, Wilmington, Del.

[21] Appl. No.: 610,099

[22] Filed: Feb. 29, 1996

[51] Int. Cl.[6] ..... H01R 9/09

[52] U.S. Cl. ..... 439/79; 439/943

[58] Field of Search ..... 439/79, 80, 943

[56] References Cited

U.S. PATENT DOCUMENTS

| | | | |
|---|---|---|---|
| 4,410,230 | 10/1983 | San Miguel . | |
| 4,425,015 | 1/1984 | Rizzo . | |
| 4,550,962 | 11/1985 | Czeschka . | |
| 4,749,357 | 6/1988 | Foley | 439/80 |
| 4,908,335 | 3/1990 | Cosmos et al. | 439/79 OR |
| 4,955,819 | 9/1990 | Harting et al. | 439/79 |
| 5,114,355 | 5/1992 | Kimmel et al. | 439/101 |
| 5,158,471 | 10/1992 | Fedder et al. | 439/80 |
| 5,199,886 | 4/1993 | Patterson | 439/79 |
| 5,252,080 | 10/1993 | Pesson | 439/79 |
| 5,259,773 | 11/1993 | Champion et al. | 439/108 |
| 5,266,038 | 11/1993 | Nakamura | 439/79 |
| 5,282,752 | 2/1994 | Doutrich et al. | 439/79 |
| 5,453,016 | 9/1995 | Clark et al. | 439/79 OR |
| 5,490,787 | 2/1996 | Bowman et al. | 439/79 |
| 5,507,655 | 4/1996 | Goerlich | 439/79 X |

FOREIGN PATENT DOCUMENTS

| | | |
|---|---|---|
| 0128306A1 | 12/1984 | European Pat. Off. . |
| WO/95/14315 | 5/1995 | WIPO . |

*Primary Examiner*—Neil Abrams
*Assistant Examiner*—Daniel Wittels

[57] ABSTRACT

An electrical connector (10) includes a housing (12) and a plurality of right angled terminals (70), each disposed in a respective terminal receiving passageway (34) thereof. The body portion (76) of the terminals includes a first push surface (78) proximate a first connecting section (72), the first push surface (78) being adapted to cooperate with a push surface (48) along a wall of a respective passageway (34) when the connector (10) is mounted to the circuit board (102). The body portion (76) of at least a portion of the plurality of terminals (70) includes a second push surface (92) proximate a second or board connecting section (94), the second push surface (92) being adapted to cooperate with a second housing push surface (60) on a housing wall proximate the connector mounting face (18). When the connector (10) is mounted to the board (102) by applying force to a top of said housing (12), the housing walls push against both terminal body portions (78, 92) to urge said second connecting portions (94) into force fit relationship within corresponding apertures (104) of the circuit board (102), thereby pushing the terminals (70) at two spaced locations and keeping the terminals (70) stabilized and in axial alignment as the connector (10) is mounted to the board (102).

5 Claims, 5 Drawing Sheets

ELECTRICAL CONNECTOR AND TERMINAL THEREFOR

FIELD OF THE INVENTION

The present invention is related to electrical connectors of the type that are mounted to a circuit board with their contact leads exiting the connector at a right angle and extending into through-holes in the board, and more particularly to such connectors that are intended to be assembled to the board by aligning the leads with the holes and then applying sufficient force to the top of the connector housing to insert the press-fit leads fully into the holes.

BACKGROUND OF THE INVENTION

Board mounted right angle connectors of the type having contact leads that interferingly engage plated through holes in a circuit board typically are assembled to the board by means of special tooling. The connector is positioned so that its contact leads are in alignment with their respective holes and the tooling is positioned so that it is in abutting engagement with shoulders or other abutting surfaces of the contacts. The tooling is then made to move toward the surface of the circuit board, forcing the contact leads into the holes until the connector is fully seated against the board. Such a connector and tooling arrangement is disclosed in U.S. Pat. No. 4,550,962, which issued Nov. 5, 1985, to Czeschka. The '962 patent teaches a connector having a two part housing and contact leads that exit the rear of the first part of the connector's housing and bend at a right angle toward the circuit board. Each contact lead has two abutting ears that extend from opposite sides thereof and a tail that is an interference fit with its respective hole in the circuit board. The insertion tooling has abutting surfaces that engage the ears of each contact lead and force their tails into their respective holes. A second part of the housing is then attached to the connector to cover the exposed leads. This connector has the disadvantage of having a separate cover housing that must be assembled by the user and requires specialized tooling to effect the insertion. Other connectors having two part housings are disclosed in U.S. Pat. No. 5,252,080 which issued Oct. 12, 1993, to Pesson and in U.S. Pat. No. 5,199,886 which issued Apr. 6, 1993, to Patterson.

What is needed is a connector having a one piece housing that can easily be assembled to a circuit board without specialized tooling.

SUMMARY OF THE INVENTION

An electrical connector is disclosed for mounting to a mounting surface of a circuit board and being electrically interconnected to circuitry on the circuit board. The improved right angle electrical connector includes a housing and a plurality of right angled terminals, each disposed in a respective terminal receiving passageway of said housing. The terminals include first and second connecting portions and an intermediate body portion. The body portion has a first push surface adapted to cooperate with a push surface along a wall of a respective the passageway when the connector is mounted to a circuit board. The improvement includes a second push surface formed on the terminal body portion of at least a portion of the plurality of terminals proximate the second connecting portion and at least one wall of the housing includes a second terminal body engaging push surfaces associated with said second push surfaces of the terminals. When the connector is mounted to the board by applying force to a top of the housing, the housing walls push against both the first and second body portions of the terminals to urge the second connecting portions into force fit relationship within corresponding apertures of the circuit board, thereby pushing the terminals at two spaced locations and keeping the terminals stabilized and in axial alignment as the connector is mounted to the board.

It is an object of the invention to provide a right angle connector and terminal therefor that can be mounted to a circuit board by applying force to the top of the connector housing without the need for specialized tools.

Embodiments of the invention will now be described by way of example with reference to the accompanying drawings.

DETAILED DESCRIPTION OF THE DRAWINGS

Figure 1:
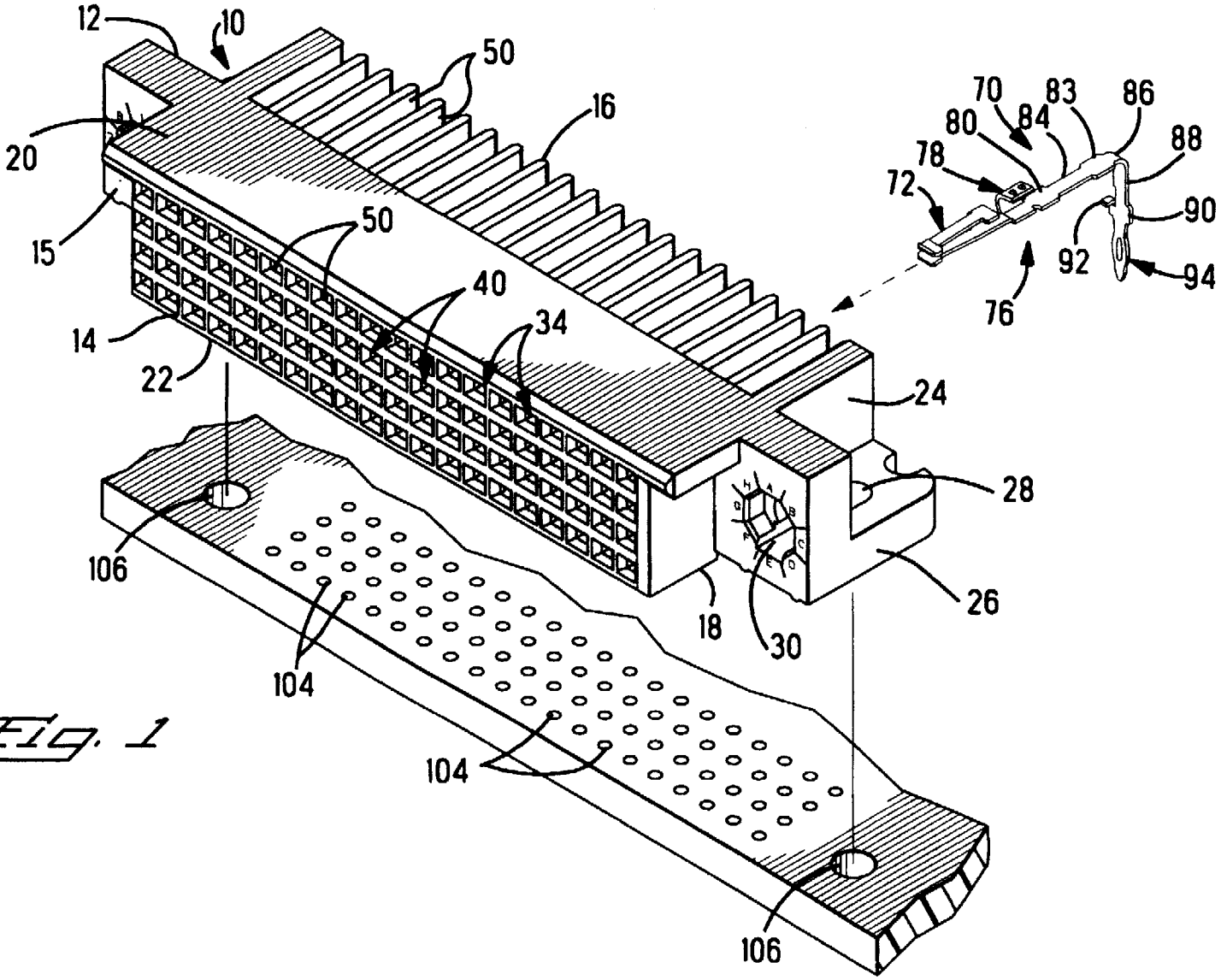
FIG. 1 is an isometric view of the electrical connector of the present invention exploded from a circuit board and having one terminal made in accordance with the invention exploded therefrom.

Referring first to FIGS. 1, 2, 3, and 6, electrical connector 10 of the present invention includes a housing 12 and a plurality of contacts 70. Housing 12 includes a mating face 14 and an opposed assembly face 16, a mounting face 18, a top wall 20, a bottom wall 22 extending along a forward portion of the mounting face 18, and end walls 24. As shown in FIG. 1, housing 12 further includes mounting flanges 26 extending outwardly from end walls 24, each having an aperture 28 for receiving mounting means (not shown), and an aperture 30 for receiving keying means (not shown) as known in the art. Mating face 14 further includes polarizing and alignment posts 15.

Housing 12 includes a plurality of terminal receiving passageways 34 extending between the mating face 14 and the assembly face 16. Passageways 34 are arranged in a plurality of rows and columns defined by horizontal walls 40 that extend between the end walls 24 and parallel to top and bottom walls 20, 22 respectively and vertical walls 50 extending parallel to the end walls 24. Terminal receiving passageways 34 include a forward portion 36 and a rearward portion 38 as best seen in FIG. 6.

Figure 2:
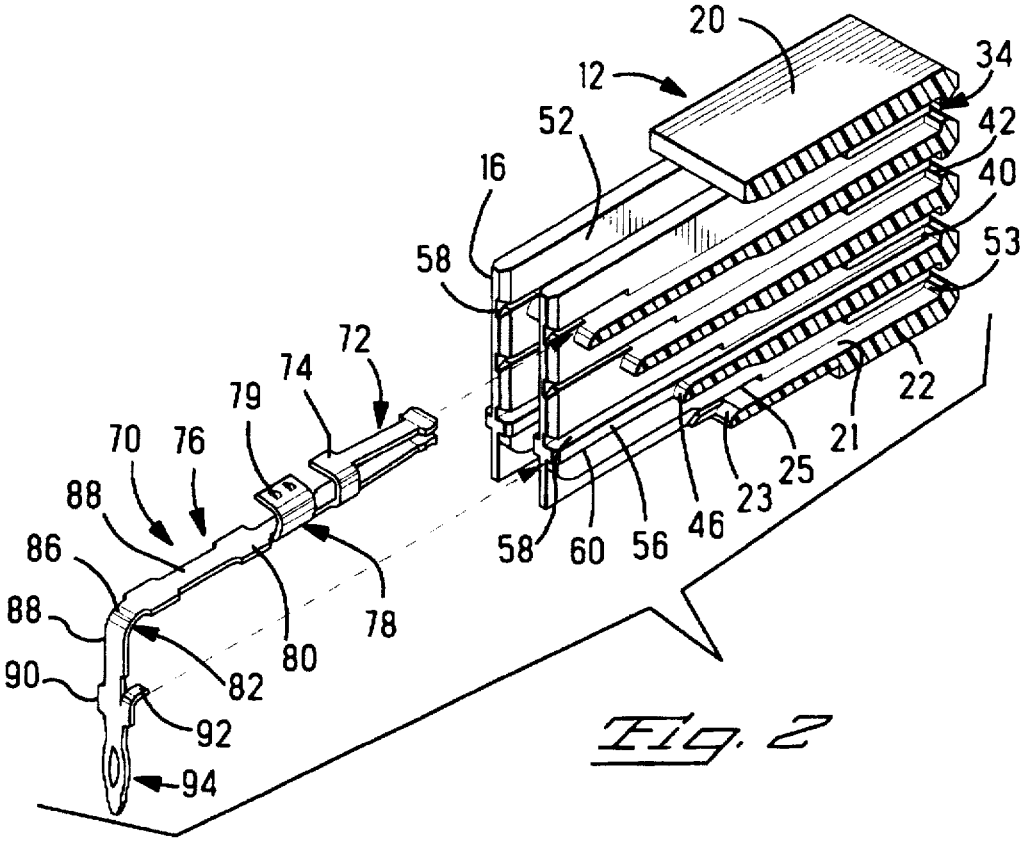
FIG. 2 is an isometric view of a terminal exploded from a fragmentary portion of the housing illustrating a terminal receiving passageway from the right side thereof.
Figure 3:
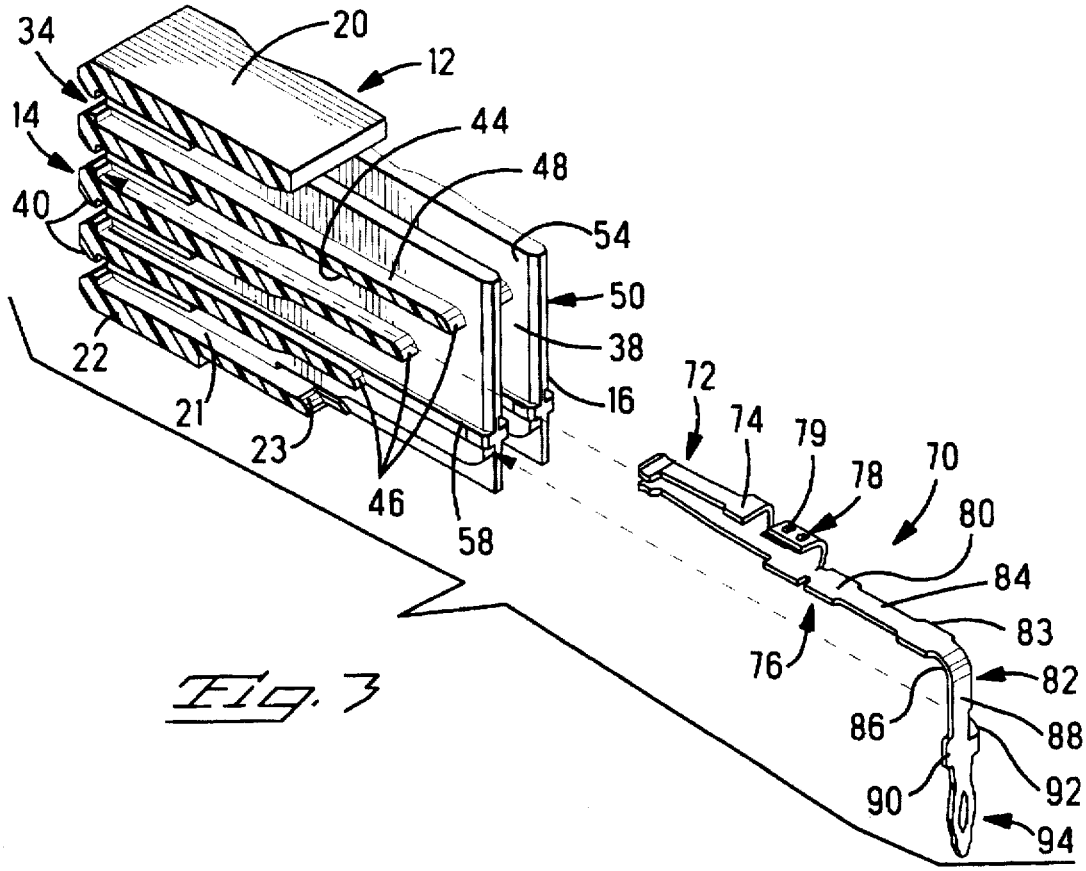
FIG. 3 is a view similar to that of FIG. 2 illustrating the terminal receiving passageway from the left side thereof.
Figure 6:
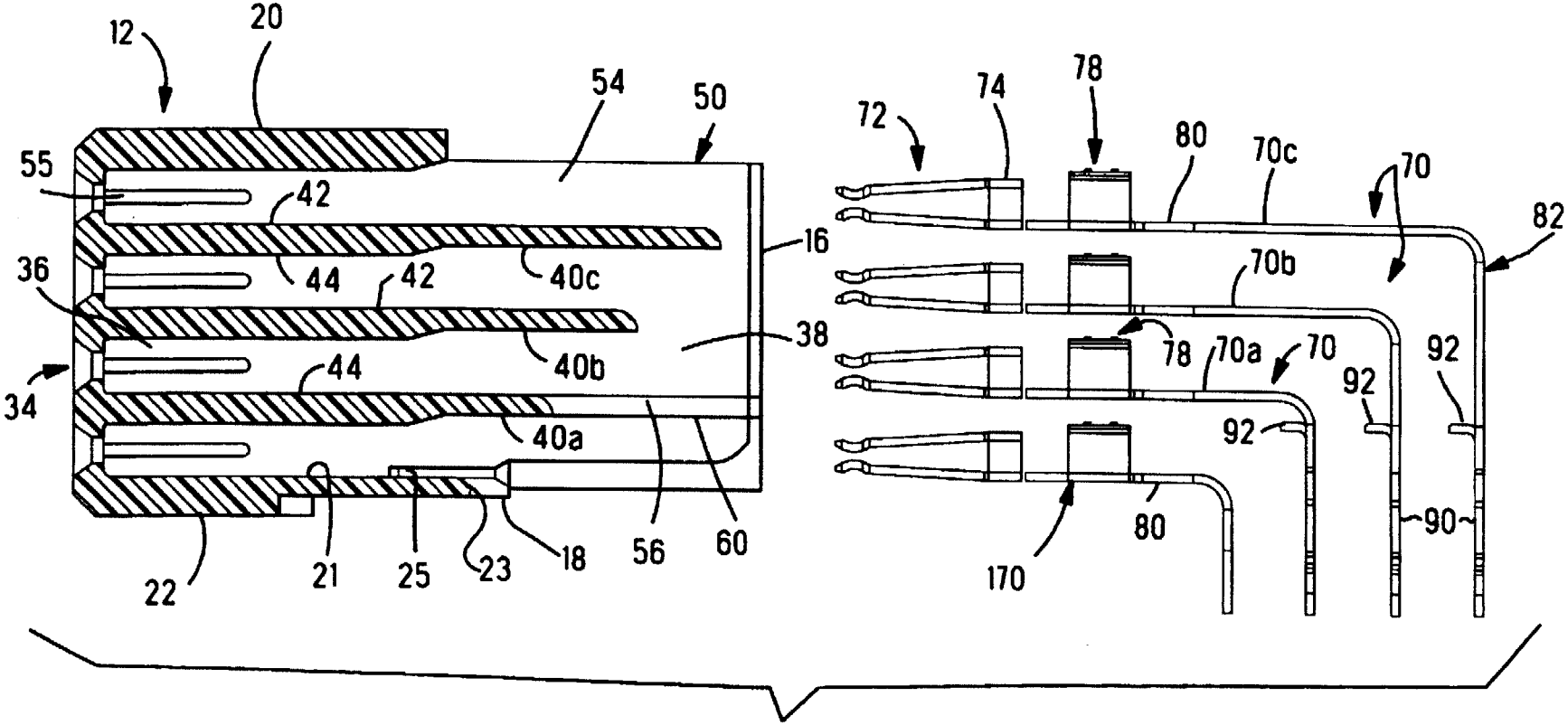
FIG. 6 is a cross-sectional view of the connectors having all of the terminals in the column exploded therefrom.

The structure of the terminal receiving passageways is best understood by referring to FIGS. 2, 3 and 6. Lower wall 22 extends from the mating face 14 a selected distance toward the assembly face 16. The inner surface 21 of lower wall 22 defines a terminal receiving surface as more fully explained below. The inner end 23 of wall 22 has a tapered surface for receiving the terminal. The horizontal walls 40 having an upper surface 42 and a lower surface 44, extend from the mating face 14 a selected distance toward the assembly face 16. Each of the horizontal walls 40 have an tapered end 46. As can be seen from these Figures, the selected distance of the lower wall 22 and the horizontal walls 40 are different, the distance being selected such that the terminals 70 when disposed thereon, will conform to the spacing of the through-holes 104 in the circuit board 102 as shown in FIG. 1.

The vertical walls 50 as shown in FIGS. 2 and 3 have a right side 52 and a left side 54. At at least one of the locations of the horizontal walls 40, guide rails 56 extend rearwardly from the end 46 of horizontal wall 40 to the assembly face 16. A guide slot 58 extends along the edge of the rib on both vertical surfaces 52, 54. Similar slots also extend along the sidewalls 52, 54 at each of the horizontal wall locations. While guide rails are shown at only one location on sidewalls 52,54, it is to be understood that the guide rails may be provided on the sidewalls at all locations of the horizontal walls 40. A slot 25 is also provided adjacent inner surface 21 of lower wall 22 for securing the lower terminal therein.

Referring now to FIGS. 1 through 5, terminal 70 includes a first connecting portion 72, a second connecting portion 94 and an intermediate body portion 76 extending therebetween. As shown herein, first connecting portion 72 has a C-shaped portion 74 and two beams 75 extend forwardly therefrom. It is to be understood that other configurations may be used for the first connecting portion. The intermediate body portion 76 includes a C-shaped portion 78 defining a first push surface as more fully explained below, an outwardly extending flange 80 and elongate substantially straight portion 82, a flange 83, and a flange 90 proximate the second connecting portion 94. Flange 90 includes tab 92 extending from the flange 90 at essentially a right angle thereto and toward the first connecting portion 72.

Figure 4:
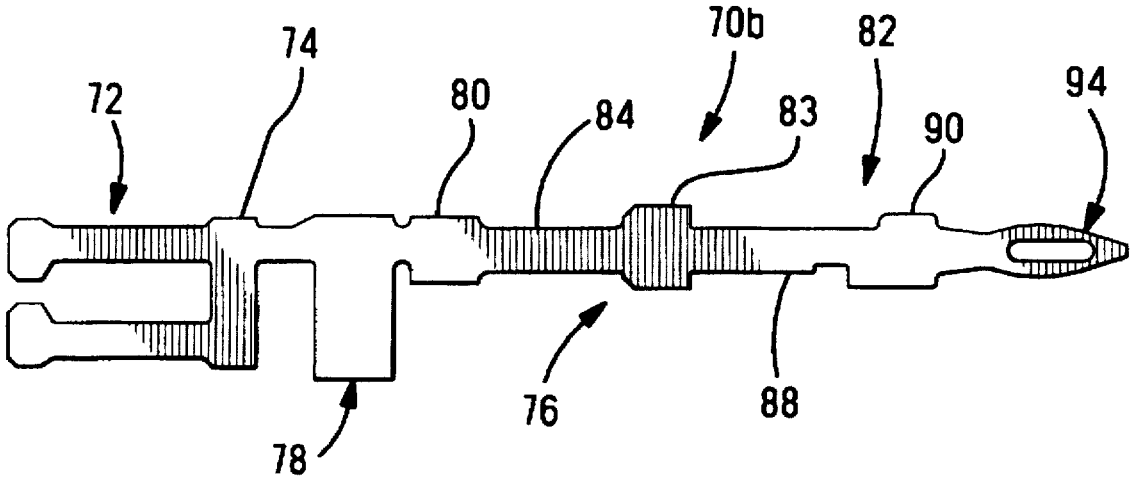
FIG. 4 is a plan view of the stamped terminal blank used to form the terminal of FIG. 2.
Figure 5:
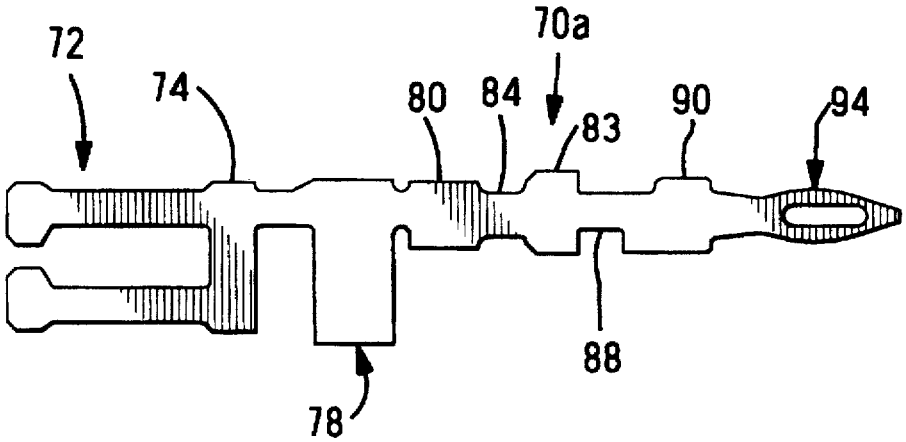
FIG. 5 is a flat plan view of a stamped terminal blank used to form the terminals in another row of passageways in the housing.

The elongate straight portion 82 includes a first section 84 dimensioned to be received on the upper surface 42 of a corresponding horizontal wall, a bend 86 dimensioned to be positioned proximate the end 46 of the corresponding wall 40 and a second section 88 dimensioned to position the second connecting portion 94 below the housing for insertion into the corresponding 104 circuit 102. Second connecting portion 94 extends below the flange 90 and, in the assembled connector extends below the housing 12 and is dimensioned to be received in an interference fit in the through-holes 104 in of the circuit board 102. The C-shaped body portion 78 includes protrusions 79 for engaging housing surfaces when the terminal 70 is disposed in forward passageway portion 36 in connector housing 12. As seen in FIGS. 4 through 7, the connector 10 of the present invention includes 3 rows of terminals 70, identified in FIG. 6 as 70*a*, 70*b*, and 70*c*, each being substantially identical to the other with the exception of the lengths of the elongate body portion 82. The terminal blanks for two of the terminals 70, 70*b* and 70*c*, which are located in different rows, are shown in FIGS. 4 and 5. While the first connecting portions, the C-shaped body portions, and the second connecting portions are identical, the elongate portion 82 for the terminal 70*c* shown in FIG. 5 has a longer first body section 84 than does terminal 70*b* of FIG. 4. The first elongate body sections 84 are dimensioned to be received on the corresponding upper surface 42 of a selected horizontal wall 40 and the longer second body sections 88 are dimensioned to position the second connecting portion 94 below the housing for insertion into the circuit board.

Figure 7:
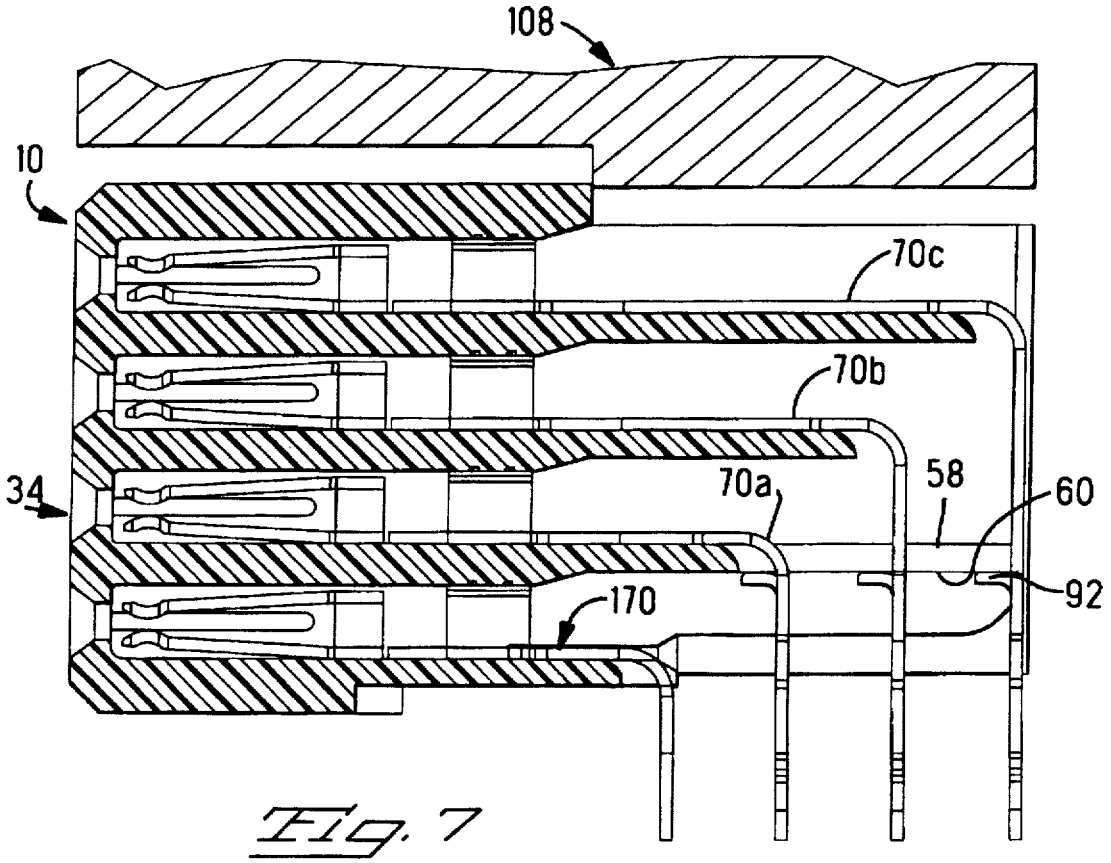
FIG. 7 is a cross-sectional view of the connector and terminals of FIG. 6 after the terminals have been disposed in their respective terminal receiving passageways.

Terminals 70 are stamped and formed from strip sheet stock in the usual manner. The terminals are made Of suitable contact material and are typically in the range of 0.006 to 0.015 inches thick. As shown in these FIGS., each of the respective flanges 90, which are adjacent the second connecting portion 94, includes an elongate tab 92 thereon that is positioned the same distance above the second connecting portion 94. The tab 92 defines a second push surface on the terminal that in the assembled connector, as shown in FIG. 7, is disposed along push surface 60 which is defined by the lower surface of guide rail 56 extending along the left side 54 of vertical wall 50. Upon inserting the respective terminals 70*a*, 70*b*, and 70*c* into the respective passageways 34 and onto the terminals support surfaces of walls 40*a*, 40*b*, and 40*c*, respectively, the first connecting portions 72 are received in the forward portions 36 of the passageways 34 with the C-shaped body portion 78 being received in an interference fit between the lower and upper surfaces 42, 44 of the respective horizontal walls 40, flange 80 is received in a slot 58 and the first sections 84 of elongate portion 82 and flange 83 thereof are disposed along the respective upper surfaces 42 of the respective horizontal walls. The corresponding bends 86 of the terminals 70 are proximate the respective ends 46 of the horizontal walls 40. The elongate tab 92, which defines the second body push surface, lies spaced along the guide rail push surface 60 of guide rail 56 extending rearwardly from the lowest horizontal wall 40*a*. The second push surfaces 92 thus are supported and held in alignment proximate the mounting face 18. Tab 92 thus presents an orthogonal push surface orthogonal to the pushing direction and having a relatively large horizontal area, larger than the horizontal cross-sectional area of the flange 90. Tab 92 is used to stabilize the contact 70 in the rearward portion 38 of housing passageway 34, and to distribute forces along push surface 60 during board insertion of second connecting portion 94 thus preventing shearing of the housing material by the thin stock terminal.

In the preferred embodiment, the second connecting portion 94 is of the type disclosed in U.S. patent application Ser. No. 08/610,097 filed concomitantly herewith. The compliant section includes an elongate hole that is offset axially with respect to outer edges of the compliant section such that the transverse median of the hole is staggered axially with respect to the widest dimension of the outer edges of the legs. The width of each leg between outer and inner edges at the first end of the hole is less than the width of each leg at the opposite second end of the hole, as seen in FIGS. 4 and 5.

As can be seen in FIGS. 6 and 7, contact 170 which is received on terminal support surface 21 of lower wall 22, is sufficiently close to the mounting surface that it does not have the second body push surface 92. The flange 80 extends into the elongate slot 25, which gives a second push surface to urge the second connecting portion 94 into a corresponding aperture 104 of circuit board 102.

FIG. 7 shows that the second connecting portions 94 of the respective contact 70, 170 are arranged in an array that corresponds to the array of plated through-holes 104 of the circuit board 102 and are thereby interconnected to circuitry thereon. FIG. 7 also shows an insertion tool 108 having a stepped surface 109 that is positioned above the connector 10 so that the stepped surfaces can engage housing 12 along the upper wall 20 and the top surface of the vertical walls 50. Force is then applied thereto as indicated by the arrows to force the compliant second connecting portions 94 into the respective holes 104 of the circuit board 102.

All the terminals 70 are shown with one second push surface 92, it is to be understood that for the longer contacts additional similar push surfaces may be provided to assist in mounting terminals in the upper rows into the board apertures.

Figure 8:
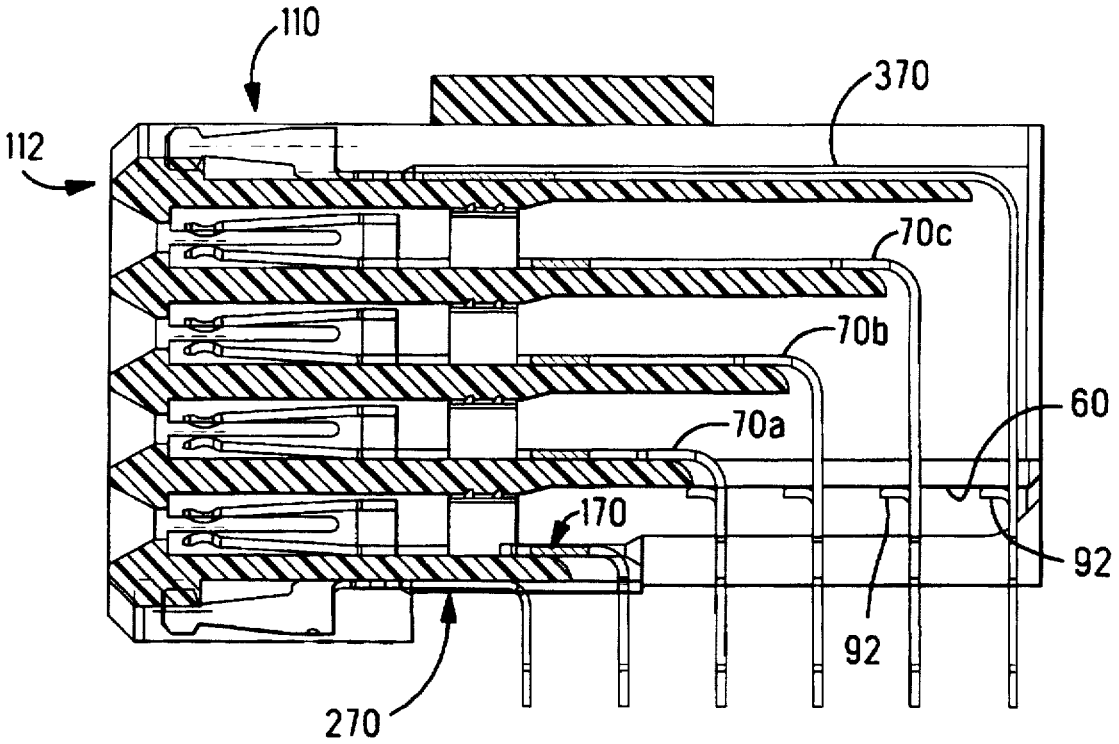
FIG. 8 is a cross-sectional view of a further embodiment of a connector made in accordance with the present invention.

FIG. 8 shows a further embodiment of the present invention having six rows of terminals with the third through fifth rows being the terminals 70*a*, 70*b* and 70*c*, as previously described and the second row being terminal 170 as previously described. Additional terminals 270 and 370 having a different configuration to minimize height requirements are used on the exterior of the upper and lower walls of the housing 112. The same two push surfaces 78 and 92 are provided for embodiment 110 as well. The upper row contact 370 has additional barb surfaces or other surfaces configured to be received in an elongate slot to provide support for the flat mounting in accordance with the present invention.

The present invention provides an important advantage in that only a one piece housing need be used to mount a right angle connector by applying an insertion tool having a flat surface to the assembled connector. The terminals used in the connector are provided with two push surfaces that cooperate with corresponding surfaces within the housing to allow use of a simple tool having a flat bearing surface. The terminals are stamped and formed from flat stock material.

It is thought that the electrical connector of the present invention and many of its attendant advantages will be understood from the foregoing description. It is apparent that various changes may be made in the form, construction, and arrangement of parts thereof without departing from the spirit or scope of the invention, or sacrificing all of its material advantages.

I claim:

1. An improved right angle electrical connector for mounting to a circuit board and including a housing and a plurality of right angled terminals, each disposed in a respective terminal receiving passageway of said housing, said terminals including first and second connecting portions extending respectively from intermediate horizontal and vertical body portions joined at the right angle, the second connecting portions having compliant sections for insertion into respective through-holes of a circuit board when pushing force is applied to the connector, and said horizontal body portion including a first push surface adapted to cooperate with a push surface along a wall of a respective said passageway when said connector is mounted to said circuit board, the improvement comprising:

said vertical body portion of at least one of said plurality of terminals includes a second push surface proximate said second connecting section and facing away from the circuit board, and at least one wall of said housing having a board-facing surface that defines a second terminal body engaging push surface and is defined as a lower surface of a guide rail, and associated with said second push surface of each said at least one terminal, whereby, when said connector is mounted to said board by applying force to a top of said housing, said housing walls push against both said body portions to urge said second connecting portions into force fit relationship within corresponding apertures of said circuit board, thereby pushing said at least one terminal at two spaced locations and keeping said terminals stabilized and in axial alignment as said connector is mounted to the board.

2. The connector as set forth in claim 1 wherein said second push surface of said at least one terminal is a tab initially extending upwardly from a lateral flange of said terminal, said tab being bent over to extend forwardly orthogonally from said vertical body portion to be disposed beneath said board-facing surface of said at least one wall of said housing and to define a push surface of an area larger than the horizontal cross-sectional area of the lateral flange.

3. The connector as set forth in claim 1 wherein said plurality of terminals are disposed in at least two rows, and each terminal in each of said at least two rows includes said second push surfaces in a common plane to be engaged by said board-facing surface of a common said at least one wall.

4. The connector as set forth in claim 3 wherein said second push surface of said at least one terminal is a tab initially extending upwardly from a lateral flange of said terminal, said tab being bent over to extend forwardly orthogonally from said vertical body portion to be disposed beneath said board-facing surface of said at least one wall of said housing and to define a push surface of an area larger than the horizontal cross-sectional area of the lateral flange.

5. The connector as set forth in claim 3 wherein said terminals of said at least two rows are vertically aligned, and said vertical body portions thereof are received into a common slot extending into said common wall from a rear edge thereof, with said second push surfaces engaged along said slot by said board-facing surface.

* * * * *